US010401007B1

(12) United States Patent
York et al.

(10) Patent No.: US 10,401,007 B1
(45) Date of Patent: Sep. 3, 2019

(54) INTEGRATED SENSING AND CONTROL OF LIGHT FIXTURES

(71) Applicants: Chenell Erika York, Atlanta, GA (US); Bobby Brooks, Senoia, GA (US)

(72) Inventors: Chenell Erika York, Atlanta, GA (US); Bobby Brooks, Senoia, GA (US)

(73) Assignee: Cooper Technologies Company, Houston, TX (US)

( * ) Notice: Subject to any disclaimer, the term of this patent is extended or adjusted under 35 U.S.C. 154(b) by 273 days.

(21) Appl. No.: 15/213,858

(22) Filed: Jul. 19, 2016

(51) Int. Cl.

| | |
|---|---|
| ***F21V 23/00*** | (2015.01) |
| ***H05B 37/02*** | (2006.01) |
| ***F21V 29/76*** | (2015.01) |
| ***F21V 23/02*** | (2006.01) |
| ***F21V 31/00*** | (2006.01) |

(52) U.S. Cl.
CPC ..... *F21V 23/008* (2013.01); *F21V 23/02* (2013.01); *F21V 29/76* (2015.01); *F21V 31/005* (2013.01); *H05B 37/0227* (2013.01); *H05B 37/0272* (2013.01)

(58) Field of Classification Search
CPC ..... H05B 37/0227; H05B 37/0272; F21V 23/008; F21V 23/02; F21V 31/005; F21V 29/76
See application file for complete search history.

(56) References Cited

U.S. PATENT DOCUMENTS

| | | | | |
|---|---|---|---|---|
| D239,315 | S | 3/1976 | Satoh et al. | |
| 4,090,178 | A * | 5/1978 | Norris | F21V 33/0076 340/506 |
| 5,442,532 | A * | 8/1995 | Boulos | F21S 8/033 340/567 |
| 5,626,417 | A * | 5/1997 | McCavit | F21S 8/033 250/353 |
| 6,956,493 | B1 * | 10/2005 | Youngblood | G08B 5/36 277/312 |
| D550,878 | S | 9/2007 | Korpi | |
| 7,463,148 | B2 * | 12/2008 | Leen | F21V 23/0435 340/545.2 |
| 7,985,017 | B2 * | 7/2011 | Quan | F21S 8/033 362/647 |
| D752,267 | S | 3/2016 | Wang | |
| D761,989 | S | 7/2016 | Dickinson | |
| D774,675 | S | 12/2016 | Hong | |
| 9,615,428 | B2 * | 4/2017 | King | H05B 37/0227 |
| 9,657,930 | B2 * | 5/2017 | Nolan | F21V 5/007 |
| 2017/0102116 | A1 * | 4/2017 | Sherry | F21V 31/00 |
| 2017/0184261 | A1 * | 6/2017 | Casper | F21S 2/005 |

* cited by examiner

*Primary Examiner* — Anh T Mai
*Assistant Examiner* — Arman B Fallahkhair
(74) *Attorney, Agent, or Firm* — King & Spalding LLP

(57) ABSTRACT

A backbox is disclosed herein. The backbox can include at least one wall forming a cavity, and a sensor mounting feature disposed on an outer surface of the at least one wall, where the sensor mounting feature is configured to couple to a sensor device. The backbox can also include at least one fixture coupling feature disposed on the at least one wall, where the at least one fixture coupling feature is configured to couple to a complementary coupling feature disposed on a housing of a light fixture. The at least one wall can be configured to extend substantially seamlessly from a portion of the light fixture at which the at least one complementary coupling feature is located.

17 Claims, 8 Drawing Sheets

INTEGRATED SENSING AND CONTROL OF LIGHT FIXTURES

TECHNICAL FIELD

The present disclosure relates generally to light fixtures, and more particularly to systems, methods, and devices for integrated sensing and control of light fixtures.

BACKGROUND

Some light fixtures are not built with a sensor and/or controller. As a result, when a sensor and/or controller is used with such a light fixture, the sensor and/or controller is mounted on or near the housing of the light fixture. When this occurs, the light fixture has reduced aesthetic appeal. Further, in some cases, if the sensor and/or controller is affixed to the housing of the light fixture, the light fixture may lose the ability to maintain a certain rating and/or maintain a certain standard that the light fixture is required to maintain. In addition, if the sensor and/or controller is located separately from the housing of the light fixture, the sensor and/or controller may not operate effectively, and so the light fixture may not operate properly.

SUMMARY

In general, in one aspect, the disclosure relates to a backbox that can include at least one wall forming a cavity, and a sensor mounting feature disposed on an outer surface of the at least one wall, where the sensor mounting feature is configured to couple to a sensor device. The backbox can also include at least one fixture coupling feature disposed on the at least one wall, where the at least one fixture coupling feature is configured to couple to a complementary coupling feature disposed on a housing of a light fixture. The at least one wall can be configured to extend substantially seamlessly from a portion of the light fixture at which the at least one complementary coupling feature is located.

In another aspect, the disclosure can generally relate to light fixture of a lighting system. The light fixture can include a main light fixture (LF) portion having at least one backbox coupling feature and at least one main LF wall that forms a first open cavity. The light fixture can also include a backbox coupled to the main light fixture portion, where the backbox includes at least one main LF coupling feature and at least one backbox wall that forms a second open cavity, where the backbox further includes a sensor mounting feature disposed on the at least one backbox wall, where the at least one main LF coupling feature couples to the at least one backbox coupling feature. The light fixture can further include a sensor device coupled to the sensor mounting feature of the backbox. The light fixture can also include a controller coupled to the sensor device and disposed within the second open cavity of the backbox. The first open cavity and the second open cavity can be enclosed when the main LF portion and the backbox are coupled to each other These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION

Figure 1A:
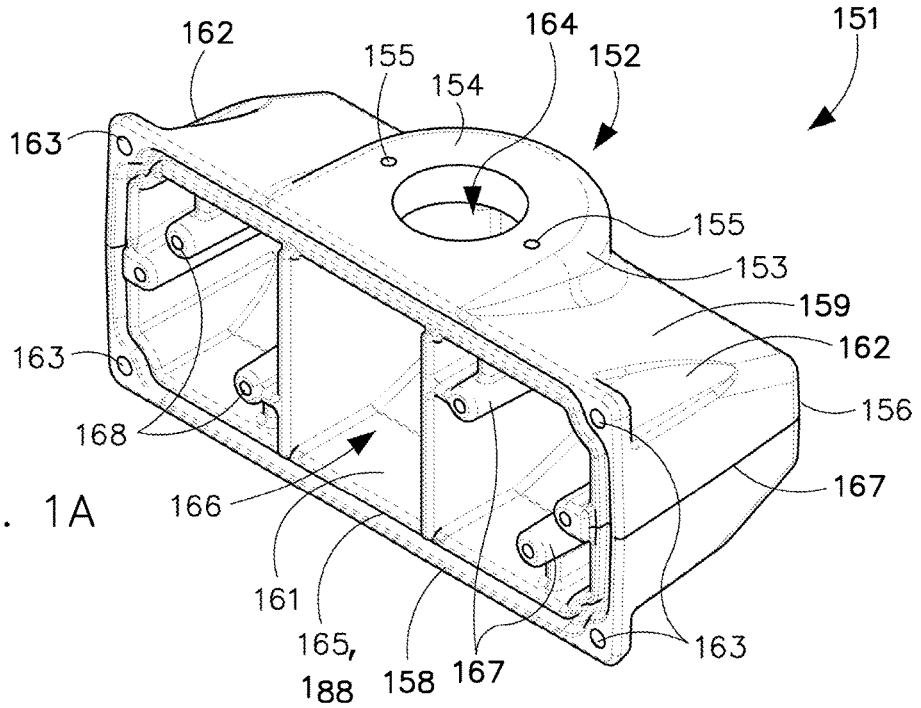
FIGS. 1A-1D show various views of a backbox housing in accordance with certain example embodiments.

The example embodiments discussed herein are directed to systems, methods, and devices for integrated sensing and control of light fixtures. Example embodiments can be directed to any of a number of types of light fixtures. Examples of such types of light fixtures can include, but are not limited to, a floodlight, a spot light, an overhead light, a can light, and an egress light. Light fixtures having integrated sensing and control can use one or more of a number of different types of light sources, including but not limited to light-emitting diode (LED) light sources, fluorescent light sources, organic LED light sources, incandescent light sources, and halogen light sources. Therefore, light fixtures used in example embodiments described herein should not be considered limited to using a particular type of light source.

Example integrated sensing and control of light fixtures can provide a number of benefits. Such benefits can include, but are not limited to, improved aesthetics of a light fixture, retrofitting existing light fixtures, reduced costs, more effective, reliable, and efficient operation of a light fixture, and compliance with industry standards that apply to light fixtures and lighting systems. The example light fixtures capable of integrated sensing and control (or components thereof, including controllers) described herein can be made of one or more of a number of suitable materials. Examples of such materials can include, but are not limited to, aluminum, stainless steel, fiberglass, glass, plastic, ceramic, and rubber. Further, such light fixtures and/or other associated components of a lighting system can meet certain standards and/or regulations.

Example backboxes, or portions thereof, described herein can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, mounting, fastening, securing, or other similar terms. Such terms are merely meant to distinguish various elements and/or features within a component or device and are not meant to limit the capability or function of that particular element and/or feature. For example, a feature described as a "coupling feature" can couple, mount, secure, fasten, abut against, and/or perform other functions aside from merely coupling.

A coupling feature (including a complementary coupling feature) as described herein can allow one or more components and/or portions of an example backbox to become mechanically coupled, directly or indirectly, to another portion of a light fixture. A coupling feature can include, but is not limited to, a portion of a hinge, an aperture, a recessed area, a protrusion, a clamp, a slot, a spring clip, a tab, a detent, and mating threads. One portion of an example backbox can be coupled to another component of a light fixture by the direct use of one or more coupling features.

In addition, or in the alternative, a portion of an example backbox can be coupled to a component of a light fixture using one or more independent devices that interact with one or more coupling features disposed on the backbox and on another component of a light fixture. Examples of such devices can include, but are not limited to, a pin, a hinge, a fastening device (e.g., a bolt, a screw, a rivet), a clamp, and a spring. One coupling feature described herein can be the same as, or different than, one or more other coupling features described herein. A complementary coupling feature as described herein can be a coupling feature that mechanically couples, directly or indirectly, with another coupling feature.

In certain example embodiments, light fixtures used for integrated sensing and control are subject to meeting certain standards and/or requirements. For example, the National Electric Code (NEC), the National Electrical Manufacturers Association (NEMA), the International Electrotechnical Commission (IEC), the Federal Communication Commission (FCC), the Illuminating Engineering Society (IES), and the Institute of Electrical and Electronics Engineers (IEEE) set standards as to electrical enclosures, wiring, and electrical connections. Use of example embodiments described herein meet (and/or allow a corresponding device to meet) such standards when required. In some (e.g., PV solar) applications, additional standards particular to that application may be met by the light fixtures described herein.

In the foregoing figures showing example embodiments of integrated sensing and control of light fixtures, one or more of the components shown may be omitted, repeated, and/or substituted. Accordingly, example embodiments of integrated sensing and control of light fixtures should not be considered limited to the specific arrangements of components shown in any of the figures. For example, features shown in one or more figures or described with respect to one embodiment can be applied to another embodiment associated with a different figure or description.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of integrated sensing and control of light fixtures will be described more fully hereinafter with reference to the accompanying drawings, in which example embodiments of integrated sensing and control of light fixtures are shown. Integrated sensing and control of light fixtures may, however, be embodied in many different forms and should not be construed as limited to the example embodiments set forth herein. Rather, these example embodiments are provided so that this disclosure will be thorough and complete, and will fully convey the scope of integrated sensing and control of light fixtures to those of ordinary skill in the art. Like, but not necessarily the same, elements (also sometimes called components) in the various figures are denoted by like reference numerals for consistency.

Terms such as "first", "second", "inner", "outer", "side", "top", "bottom", "back", "rear", "distal", and "within" are used merely to distinguish one component (or part of a component or state of a component) from another. Such terms are not meant to denote a preference or a particular orientation, and are not meant to limit embodiments of integrated sensing and control of light fixtures. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
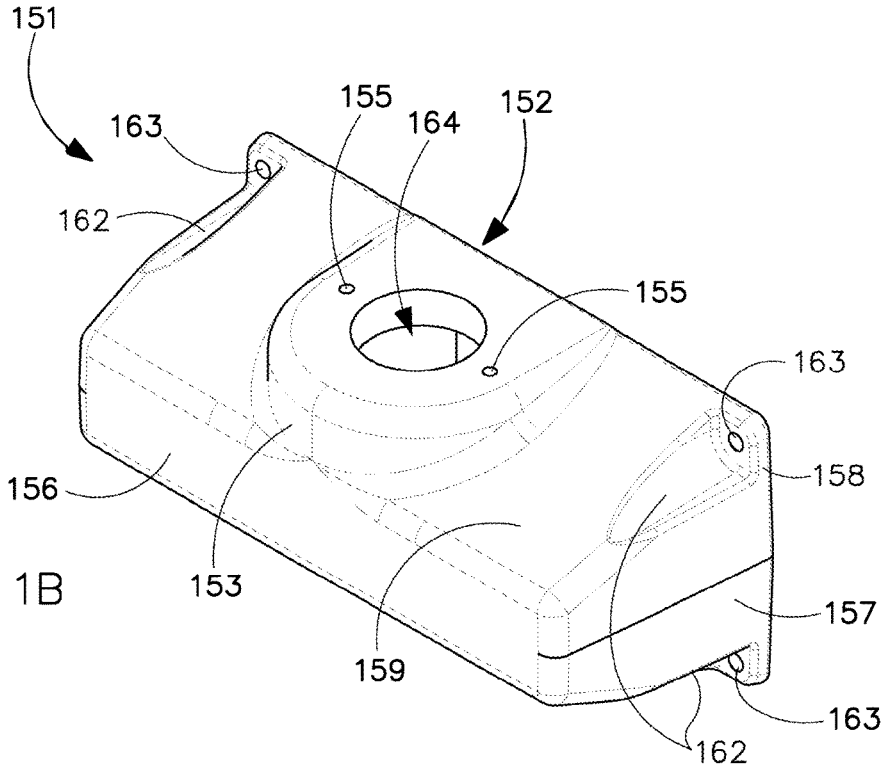
Figure 1C:
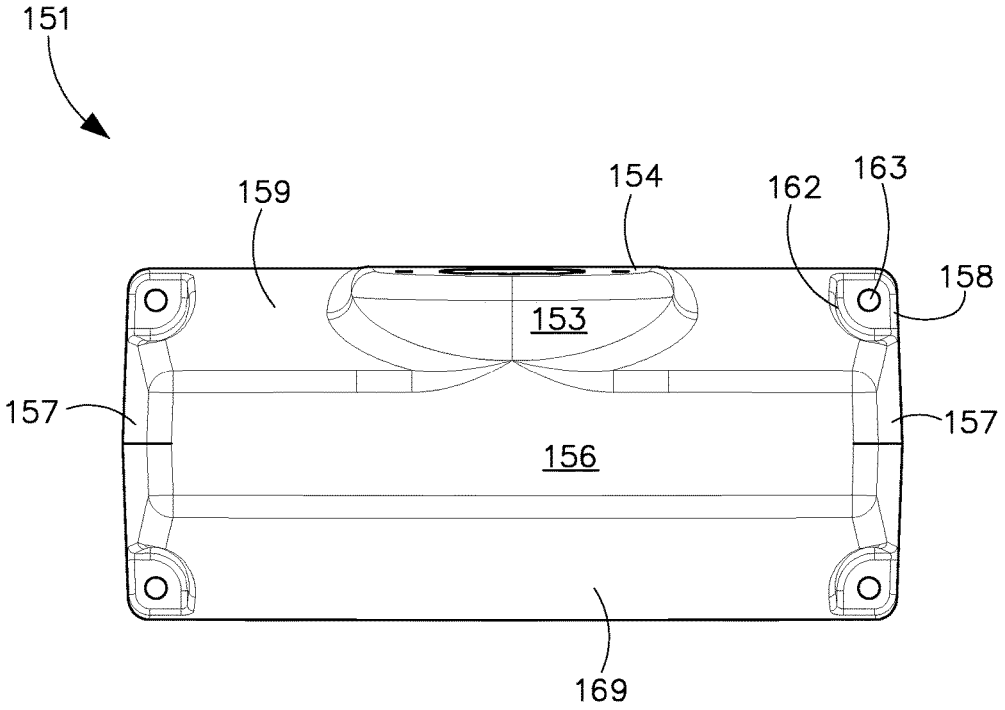
Figure 1D:
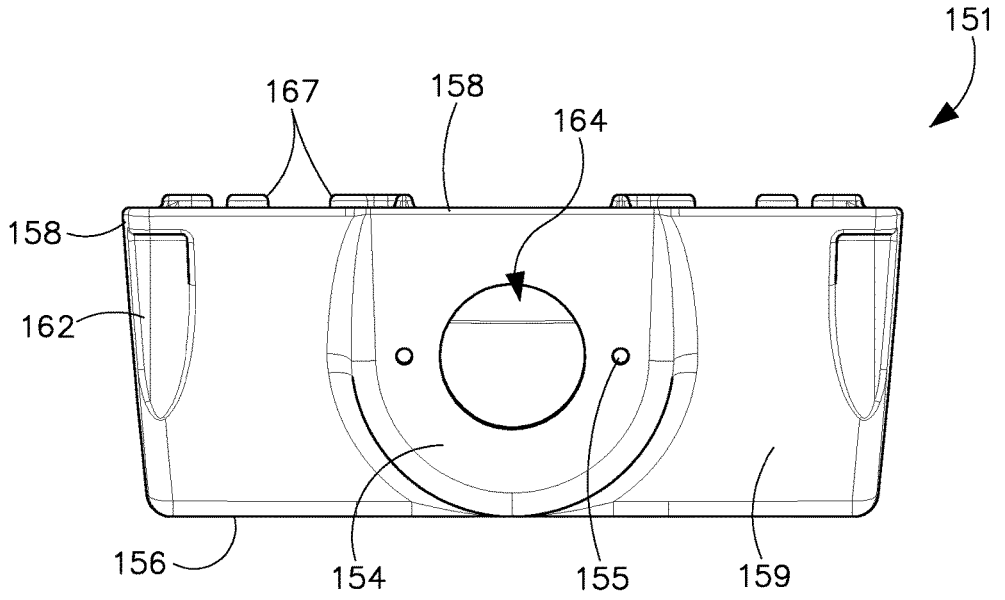

FIGS. 1A-1D show various views of a backbox housing 151 in accordance with certain example embodiments. Specifically, FIG. 1A shows a front-top perspective view of the backbox housing 151. FIG. 1B shows a rear-top perspective view of the backbox housing 151. FIG. 1C shows a rear view of the backbox housing 151. FIG. 1D shows a top view of the backbox housing 151. The backbox housing 151 can include one or more of a number of features and/or components.

For example, as shown in FIGS. 1A-1D, the backbox housing 151 can have one or more walls (e.g., top wall 159, bottom wall 169, side walls 157, back wall 156, distal wall 158) that form any of a number of shapes (e.g., semi-spherical, rectangular, trapezoidal) and define a cavity 166 that has at least one open end (in this case, at the distal end of the backbox housing 151). The backbox housing 151 can include one or more of a number of coupling features 163 that are used to couple the backbox housing 151, directly or indirectly, to a main light fixture portion (described below). In this case, each of the coupling features 163 are apertures (e.g., threaded, featureless) that traverses a wall (in this case, the distal wall 158) of the backbox housing 151. In this case, there is a coupling feature 163 disposed at each of the four corners along the distal wall 158.

In certain example embodiments, the backbox housing 151 can include one or more of a number of features to accommodate the coupling features 163. For example, in this case, there is a recess 162 in at least one wall that is located adjacent to each coupling feature 163. This recess 162 makes a fastening device that is inserted into and/or withdrawn from a coupling feature 163 more accessible to a user. Each recess 162 of FIGS. 1A-1D can have a depth sufficient to allow a screwdriver to extend unimpeded to an adjacent coupling feature 163.

Figure 2A:
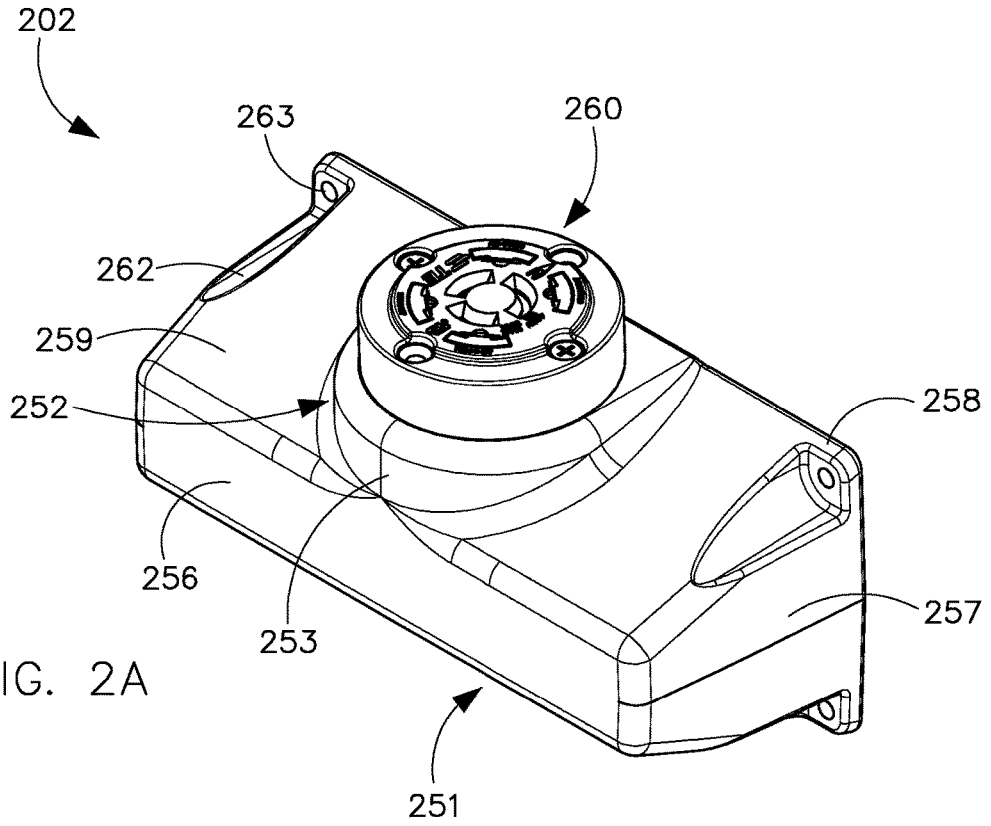
FIGS. 2A and 2B show various views of a backbox in accordance with certain example embodiments.
Figure 2B:
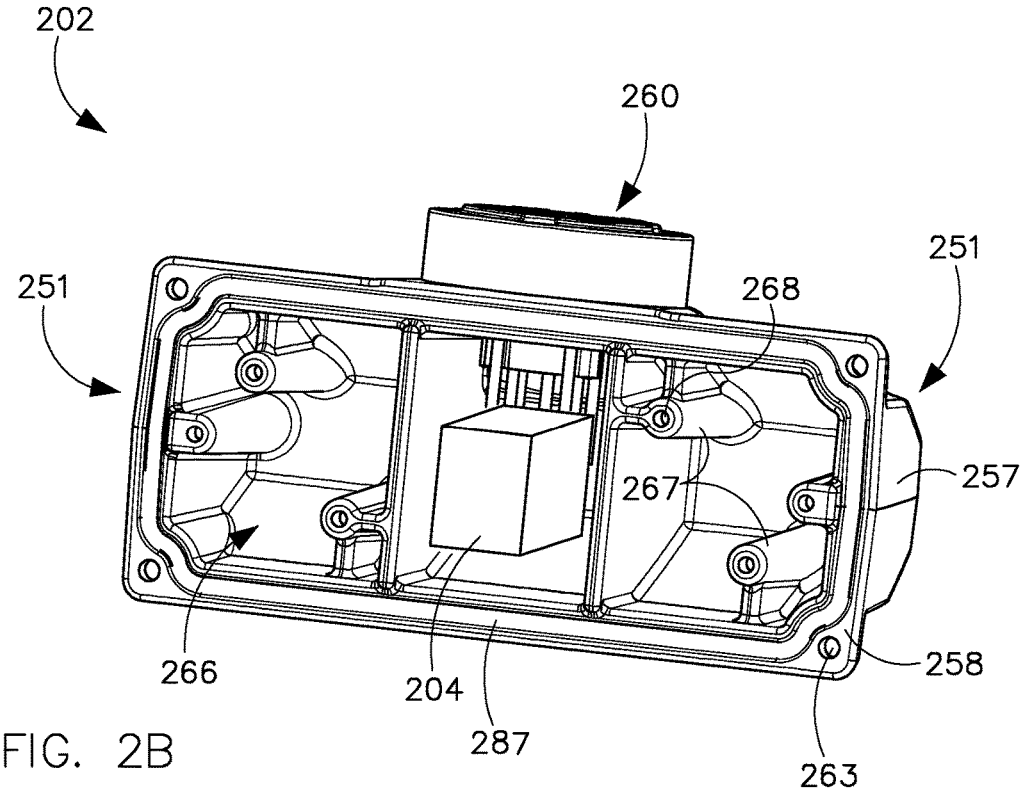

In certain example embodiments, the backbox housing 151 can also include one or more sensor mounting features 152 disposed on an outer surface of at least one wall. In this case, there is a single sensor mounting feature 152 disposed on the top wall 159. A sensor mounting feature 152 is configured to receive and couple to a sensor device, as shown in FIGS. 2A and 2B below. A sensor mounting feature 152 can include one or more of a number of features and/or components. For example, in this case, the sensor mounting feature 152 includes a back wall 153, a top wall 154, an aperture 164 that traverses the top wall 154 (and also the top wall 159), and one or more coupling features 155 disposed in the top wall 154.

The back wall 153 elevates a portion of the top wall 154 relative to the top wall 159 to position the sensor device in a certain orientation relative to the backbox housing 151. The aperture 164 is disposed substantially in the middle of the top wall 154. The coupling features 155 in this case are two apertures (e.g., threaded, featureless) that traverse at least a portion of the top wall 154 of the sensor mounting feature 152. In this case, the two coupling features 155 are disposed opposite each other relative to the aperture 164. The aperture 164 can be large enough to accommodate at least a portion of the sensor device coupled to the sensor mounting feature 152.

While this example shows that the sensor mounting feature 152 is disposed on the top wall 159, one or more sensor mounting features can be disposed at any other location on the backbox housing 151, including but not limited to the bottom wall 169 and a side wall 157. Further, if the sensor device coupled to the sensor mounting feature 152 does not need to be exposed to the ambient environment to measure the one or more parameters that it is intended to measure, then the sensor mounting feature 152 (and so the sensor device coupled to the sensor mounting feature 152) can be disposed within the cavity 166 formed by the backbox housing 151.

At the distal end of the backbox housing 151, which is what abuts against and/or couples to the main light fixture portion (as described below with respect to FIG. 3), there can be one or more of a number of features and/or components integrated with the distal wall 158. For example, there can be a protrusion that extends outward from the distal wall 158 along the perimeter of the distal wall 158. Such a protrusion can be a type of coupling feature that is inserted into a channel in the main light fixture portion. As another example, as shown in FIG. 1A, there can be a channel 165 (a type of coupling feature) that runs along the perimeter of the distal wall 158. In such a case, a sealing member 188 (e.g., a gasket, silicone) can be disposed within the channel 165 to provide a liquid-tight seal between the backbox housing 151 and the main light fixture portion when a complementary protrusion (another type of coupling feature) of the main light fixture portion is inserted into the channel 165. The protrusion, the channel 165, and/or other similar features can allow a light fixture that includes an example backbox housing 151 to meet certain standards and/or regulations that apply to the light fixture.

In certain example embodiments, the backbox housing 151 can include one or more standoffs 167 disposed within the cavity 166 and that extend from the back wall 156, the top wall 159, the bottom wall 169, and/or a side wall 157 toward the distal end of the backbox housing 151. The standoffs 167 can be used to help stiffen and reinforce the structural integrity of the backbox housing 151. In addition, or in the alternative, other features (e.g., walls) can also be disposed within the cavity 166 to add to the structural integrity of the backbox housing 151. If a standoff 167 extends beyond the distal wall 158, as shown in FIG. 1D, the standoff 167 can also be used to couple to (e.g., abut against) a portion of the main light fixture portion. In some cases, the standoff 167 can include one or more of a number of coupling features 168 (e.g., aperture, as shown in FIG. 1A, protrusions) that can be used to couple, directly or indirectly, the backbox housing 151 to the main light fixture portion.

The backbox housing 151 of FIGS. 1A-1D is so called because, according to example embodiments, it is coupled to a back end of a main light fixture portion, as shown in FIGS. 4A-6 below. Those of ordinary skill in the art will appreciate that, in spite of its name, the example backbox housing 151 can be coupled to any other portion (e.g., a top surface, a bottom surface, a side surface) of a main light fixture portion while still integrating the sensing and control functions described herein into a light fixture. The example backbox housing 151 can include one or more of a number of other features not shown in FIGS. 1A-1D. For example, one or more heat sink fins can be disposed on the outer surface of at least a portion of the backbox housing 151.

FIGS. 2A and 2B show various views of a backbox 202 in accordance with certain example embodiments. Specifically, FIG. 2A shows a rear-top perspective view of the backbox 202. FIG. 2B shows a front-side perspective view of the backbox 202. The backbox 202 includes a backbox housing 251, at least one sensing device 260, and a controller 204. The backbox housing 251, including its various features and components (e.g., sensor mounting feature 252, coupling features 263), can be substantially similar to the backbox housing 151, including its various features and components, described above with respect to FIGS. 1A-1D, except as described below. For example, as shown in FIG. 2B, the backbox 202 has a protrusion 287 that extends outward from the distal wall 258 along the perimeter of the distal wall 258. In other words, the backbox 202 has a protrusion 287 rather than a channel (e.g., channel 165 in FIG. 1A) to allow the backbox 202 to create a liquid-tight seal with the main light fixture portion.

The sensor device 260 of FIGS. 2A and 2B is coupled to the sensor mounting feature 252 of the backbox housing 251, and so is exposed to the ambient environment to measure one or more parameters (e.g., motion, temperature, ambient light) in the ambient environment. The controller 204 of FIGS. 2A and 2B is disposed within the cavity 266 of the backbox housing 251. The sensor device 260 and the controller 204 are coupled to each other. In this way, the controller 204 can instruct the sensor device 260 to perform a measurement. In addition, or in the alternative, the controller 204 can receive the measurements taken by the sensor device 260, interpret the measurements, and instruct the power supply of a main light fixture portion (described below) to operate in a certain way, thereby controlling the light output by the light sources of the main light fixture portion. The sensor device 260 and the controller 204 are described in more detail below with respect to FIG. 7.

Figure 3:
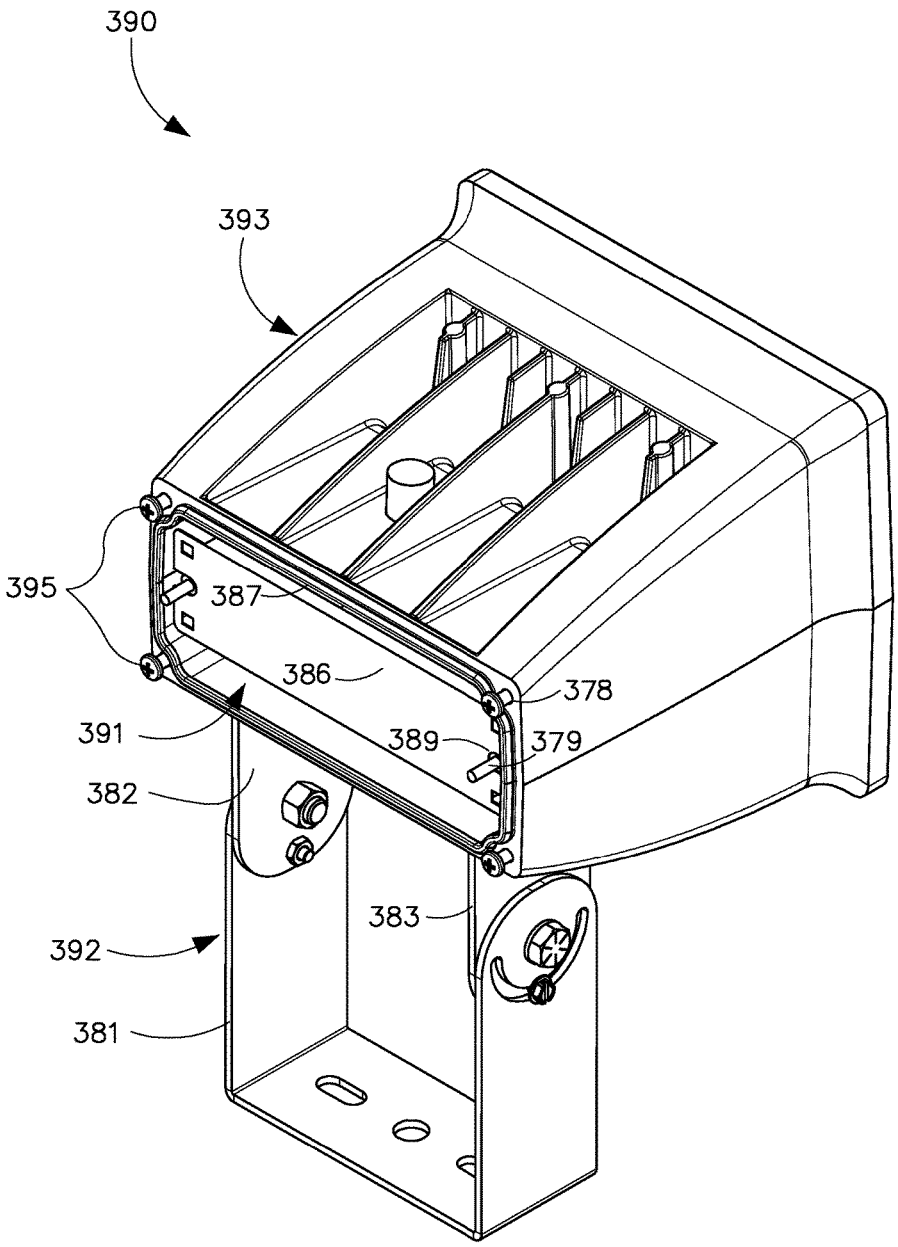
FIG. 3 shows a rear-side perspective view of a portion of a floodlight currently used in the art.

FIG. 3 shows a rear-side perspective view of a portion of a floodlight 390 (also called a main light fixture portion 390 herein) currently used in the art. The main light fixture portion 390 is substantially the same as an entire light fixture, except that one or more components are removed to allow for coupling to an example backbox (e.g., backbox 202). For example, in this case, the back panel is removed, exposing an end plate 386 at a distal end of the cavity 391 formed by and disposed within the housing 393 of the main light fixture portion 390. The end plate 386 can have one or more throughholes 389 through which one or more electrical conductors 379 can be disposed. The electrical conductors 379 can provide electrical communication between the sensor device (e.g., sensor device 260) and/or the controller (e.g., controller 204) of the backbox (e.g., backbox 202) and one or more components (e.g., a light source, a power supply) disposed within the cavity 391 of the main light fixture portion 390. By removing the back panel of the light fixture, one or more independent coupling features 395 (in this case, screws) used to secure the back panel can be used to couple to the example backbox (e.g., backbox 202). In this case, the coupling features disposed on the housing 393 of the main light fixture portion 390 include four apertures 378 disposed in at least a portion of one or more walls that form the housing 393, as well as a protrusion 387 that extends outward from the back of the main light fixture portion 390. The protrusion 387 can be inserted into a complementary channel (e.g., channel 165) of a backbox housing (e.g., backbox housing 151). In such a case, the complementary channel can have disposed therein a sealing member (e.g., sealing member 188) to maintain a liquid-tight seal when the protrusion 387 of the the main light fixture portion 390 is disposed in the complementary channel of the backbox housing.

The main light fixture portion 390 can include one or more features that a light fixture currently used in the art typically includes. For example, the main light fixture portion 390 can include a mounting assembly 392, coupled to the housing 393, for mounting the light fixture at a certain location and/or placing the light fixture in a certain position. The mounting assembly 392 can have any of a number of features and/or components. For example, in this case, the mounting assembly 392 can include a U-shaped bracket 381 that is rotatably coupled to a mounting bracket 382 and a mounting bracket 383, which are in turn coupled to the bottom of the housing 393 of the main light fixture portion 390.

As another example, the main light fixture portion 390 can include at least one power supply 340 and at least one light source (hidden from view). The light source and the power supply 340 are described in more detail below with respect to FIG. 7. When the example backbox is coupled to the main light fixture portion 390, as shown in FIGS. 4A-7 below, the controller (e.g., controller 204) of the backbox (e.g., backbox 202) can be coupled to the power supply 340. In such a case, the controller of the backbox can control (e.g., dimming, on/off, color) the power supply 340, thereby controlling the light emitted by the light sources. As still another example, the main light fixture portion 390 can include any of a number of heat sink fins.

Figure 4B:
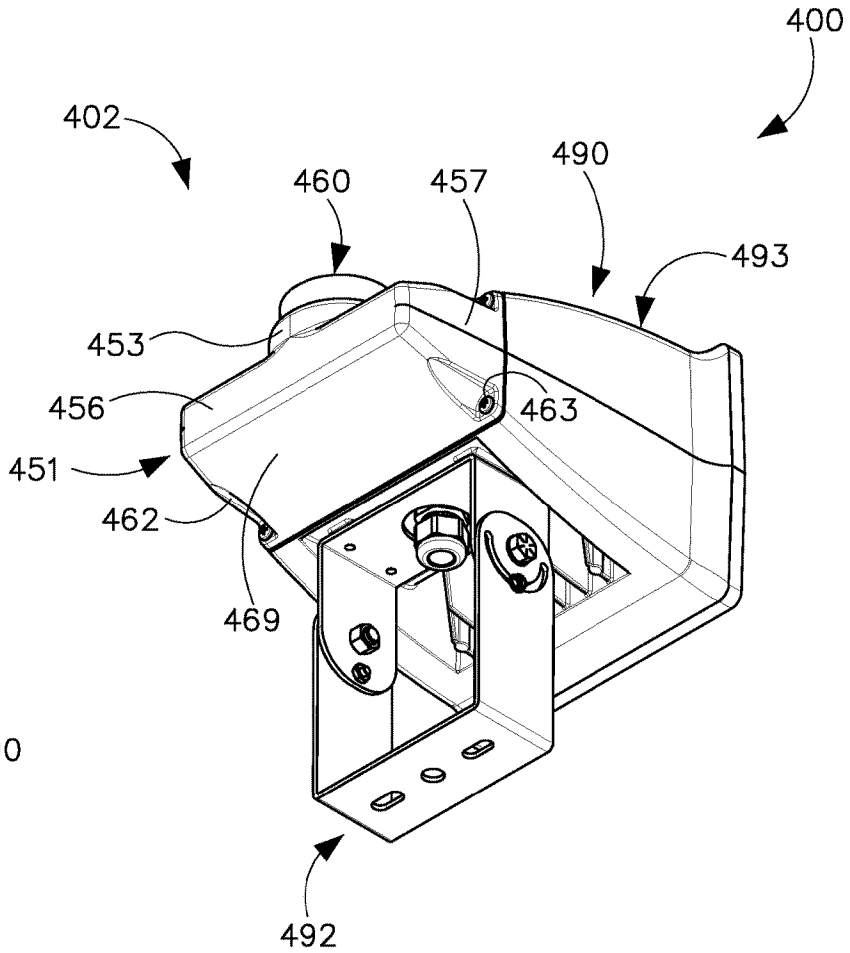
FIGS. 4A and 4B show a light fixture in accordance with certain example embodiments.
Figure 4A:
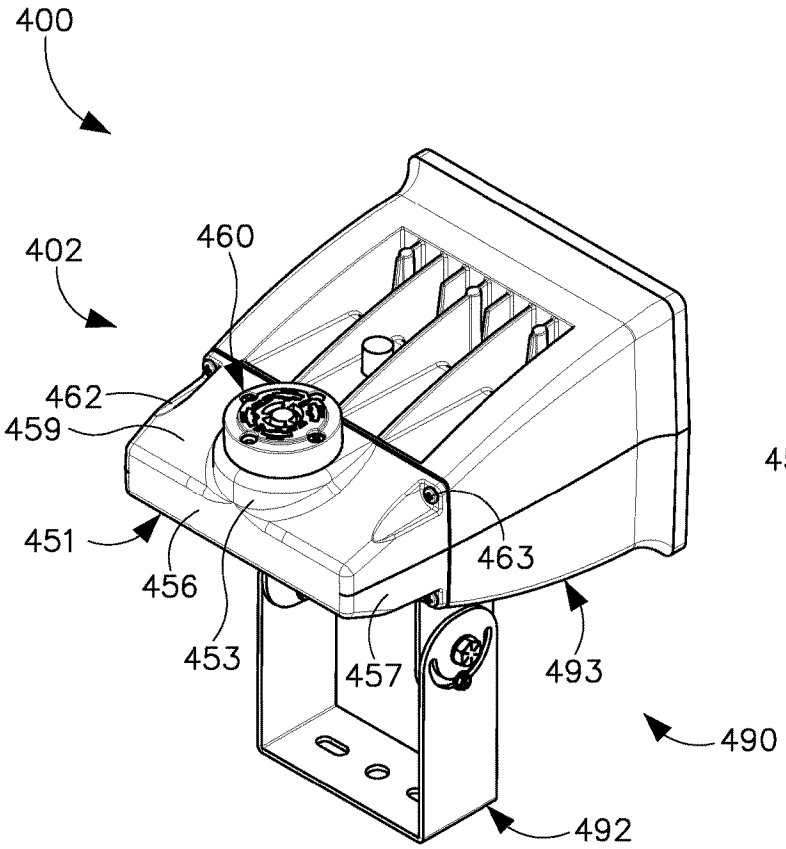

FIGS. 4A and 4B show a light fixture 400 in accordance with certain example embodiments. FIG. 4A shows a rear-top perspective view of the light fixture 400, and FIG. 4B shows a rear-bottom perspective view of the light fixture 400. The light fixture 400 of FIGS. 4A and 4B include a main light fixture portion 490 (substantially similar to the main light fixture portion 390 described above with respect to FIG. 3) that is coupled to an example backbox 402, which can be substantially similar to the backbox 202 described above with respect to FIGS. 2A and 2B.

As can be seen from FIGS. 4A and 4B, the light fixture has a seamless and streamlined look, while also having integral sensing (using the sensor device 460) and control (using the controller, hidden from view). In other words, when the example backbox 402 is coupled to the main light fixture portion 490, the backbox 402 appears to be a natural extension of the main light fixture portion 490. One or more characteristics (e.g., color, texture, material) of the backbox housing 451 can be customized to match the corresponding characteristics of the housing 493 of the main light fixture portion 490.

Figure 6:
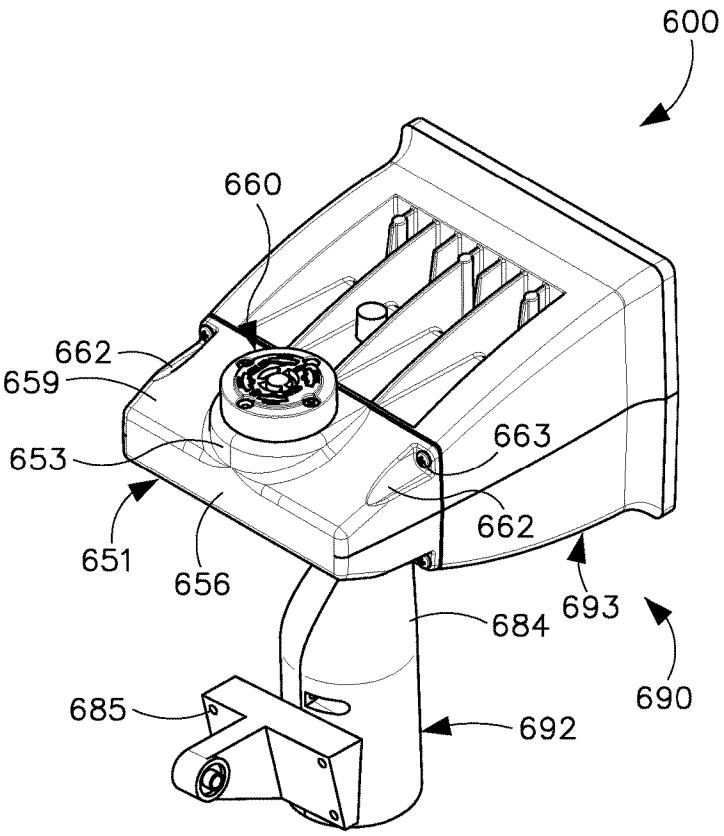
FIGS. 5 and 6 show alternative light fixtures in accordance with certain example embodiments.
Figure 5:
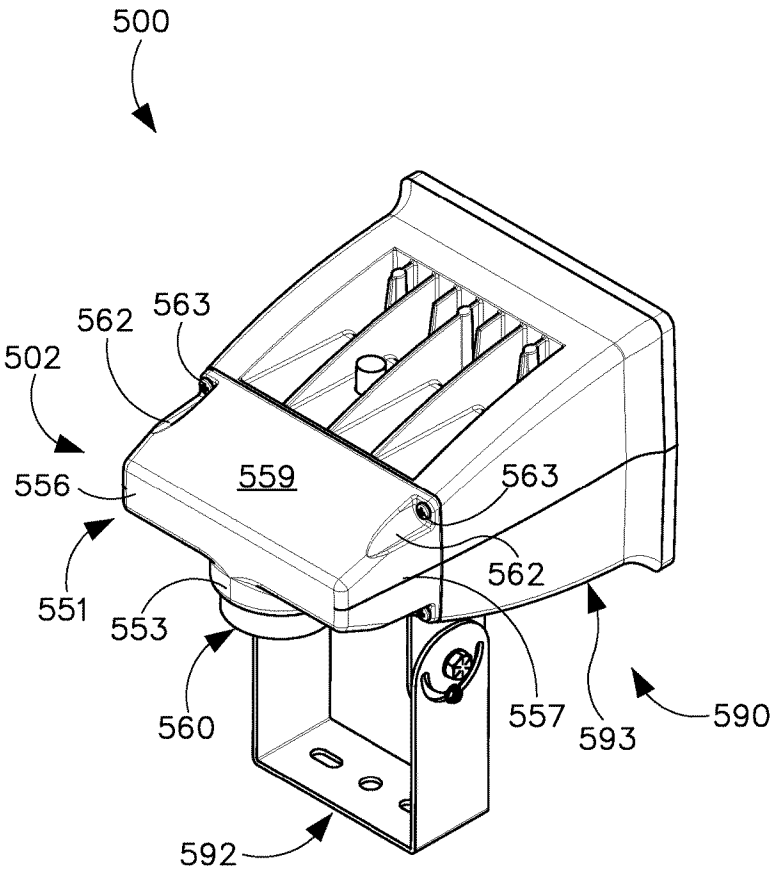

FIGS. 5 and 6 show alternative light fixtures in accordance with certain example embodiments. Specifically, FIG. 5 shows a light fixture 500 that is substantially similar to the light fixture 400 of FIGS. 4A and 4B, except that in the case of the light fixture 500 of FIG. 5, the backbox 502 is rotated 180° so that the sensor device 560 is directed downward rather than upward. In this way, the top wall 459 of the backbox housing 451 of FIGS. 4A and 4B becomes the bottom wall (hidden from view) of the backbox housing 551 of FIG. 5, and the bottom wall 469 of the backbox housing 451 of FIGS. 4A and 4B becomes the top wall 569 of the backbox housing 551 of FIG. 5.

FIG. 6 shows a light fixture 600 that is substantially similar to the light fixture 400 of FIGS. 4A and 4B, except that in the case of the light fixture 600 of FIG. 6, the mounting assembly 692 has a different configuration. Specifically, the mounting assembly 692 of FIG. 6 includes a post 684 that extends from a bottom portion of the housing 693, and a bracket 685 that allows for adjustment of the tilt angle in the light fixture 600.

Figure 7:
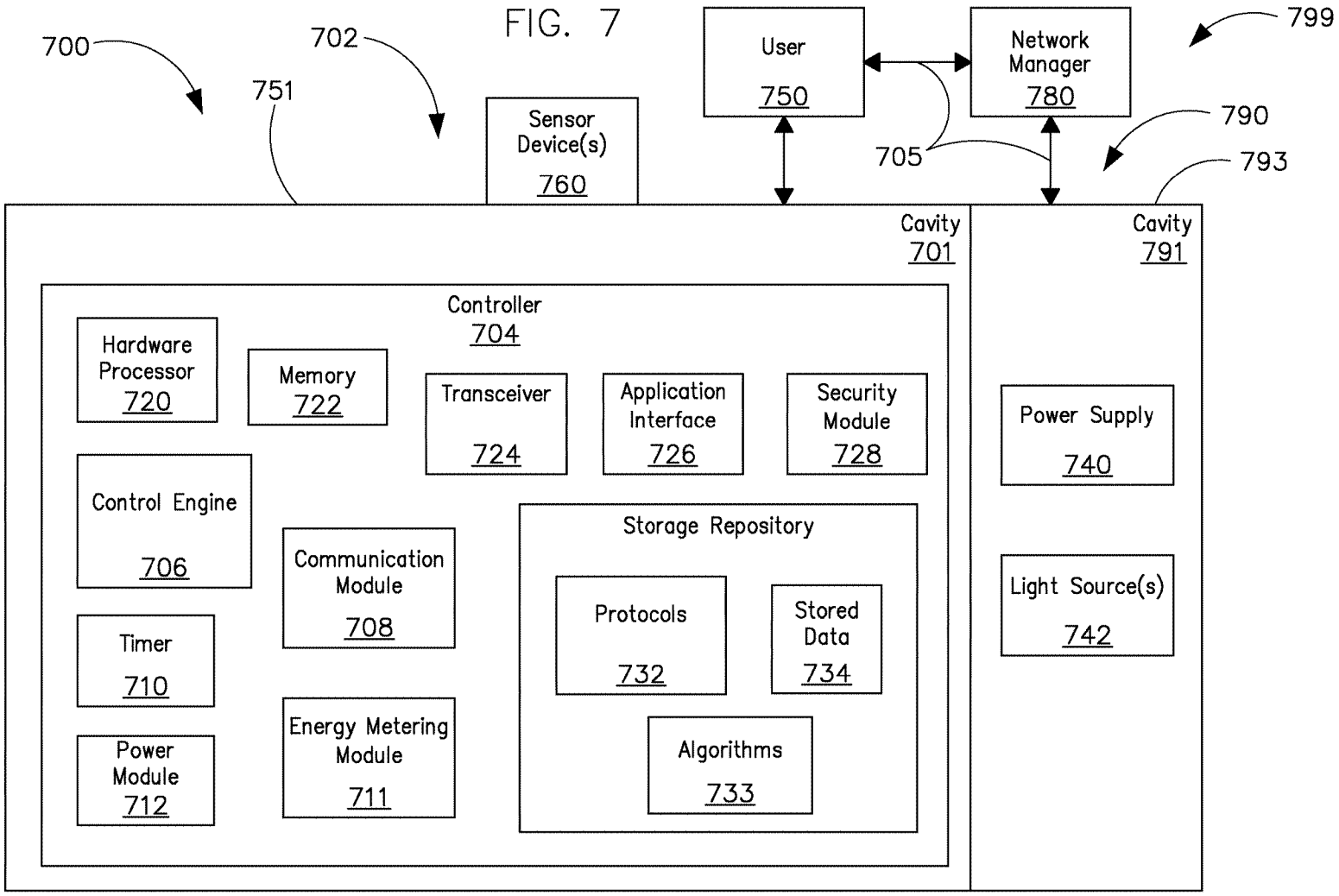
FIG. 7 shows a system diagram of a lighting system that includes a light fixture in accordance with certain example embodiments.

FIG. 7 shows a system diagram of a system 799 that includes a light fixture 790. The light fixture 790 of FIG. 7 can include a main light fixture portion 790 and a backbox 702 in accordance with certain example embodiments. The main light fixture portion 790 and the backbox 702 can be coupled to each other. In addition, the system 799 can include a user 750 and a network manager 780. The backbox 702 can include one or more sensor devices 760 (also sometimes called sensor modules 760 or, more simply, sensors 760 and a controller 704. The main light fixture portion 790 can include a power supply 740 and one or more light sources 742.

The controller 704 can include one or more of a number of components. Such components, can include, but are not limited to, an control engine 706, a communication module 708, a timer 710, an energy metering module 711, a power module 712, a storage repository 730, a hardware processor 720, a memory 722, a transceiver 724, an application interface 726, and, optionally, a security module 728. The components shown in FIG. 7 are not exhaustive, and in some embodiments, one or more of the components shown in FIG. 7 may not be included in the example light fixture 700. Any component of the example light fixture 700 can be discrete or combined with one or more other components of the light fixture 700.

A user 750 may be any person that interacts with light fixtures, such as light fixture 700. Examples of a user 750 may include, but are not limited to, an engineer, an electrician, an instrumentation and controls technician, a mechanic, an operator, a consultant, a foreman, a contractor, and a manufacturer's representative. The user 750 can use a user system (not shown), which may include a display (e.g., a GUI). The user 750 interacts with (e.g., sends data to, receives data from) the controller 704 of the light fixture 700 via the application interface 726 (described below). The user 750 can also interact with a network manager 780 and/or any of the other light fixtures in the system 799.

Interaction between the user 750 and the light fixture 700 (or components thereof, such as the controller 704 and a sensor 760) and/or the network manager 780 can be conducted using communication links 705. Each communication link 705 can include wired (e.g., Class 1 electrical cables, Class 2 electrical cables, electrical connectors, power line carrier, DALI, RS485, 3-wire cable, 7-wire cable) and/or wireless (e.g., Wi-Fi, visible light communication, cellular networking, Bluetooth, WirelessHART, ISA100) technology. For example, a communication link 705 can be (or include) one or more electrical conductors that are coupled to the housing 751 of the backbox 702 and/or the housing 793 of the main portion 790 of the light fixture 700. The communication link 705 can transmit signals (e.g., power signals, communication signals, control signals, data) between one or more light fixtures (e.g., light fixture 700), the user 750, and/or the network manager 780. One or more communication links can also be used to transmit signals between the sensor device 760 and the controller 704, and between the controller 704 and the power supply 740.

The network manager 780 is a device or component that controls all or a portion of a communication network of the system 799 that includes the controller 704 of the backbox 702 and/or the sensors 760. The network manager 780 can be substantially similar to the controller 704. Alternatively, the network manager 780 can include one or more of a number of features in addition to, or altered from, the features of the controller 704 described below. As described herein, communication with the network manager 780 can include communicating with one or more other components (e.g., another light fixture) of the system 799. In such a case, the network manager 780 can facilitate such communication.

The one or more sensors 760 can be any type of sensing device that measures one or more parameters. Examples of types of sensors 760 can include, but are not limited to, a passive infrared sensor, a photocell, a pressure sensor, a thermometer, a barometer, a camera, and an air flow monitor. A parameter that can be measured by a sensor 760 can include, but is not limited to, motion, light, temperature, pressure, relative humidity, and air toxicity. In some cases, the parameter or parameters measured by a sensor 760 can be used to control the light fixture 700.

Each sensor 760 can use one or more of a number of communication protocols. A sensor 760 can be associated with the light fixture 700 or another light fixture in the system 799. A sensor 760 can be located within the housing 751 of the backbox 702, within the housing 793 of the main light fixture portion 790, disposed on the housing 751 of the backbox 702, disposed on the housing 793 of the main light fixture portion 790, or located remotely from the light fixture 700.

In some cases, a single sensor 760 can be shared by more than one light fixture 700. A sensor 760 can be part of, or separate from, the controller 704, but in any case, the sensor 760 can be communicably coupled to the controller 704. In certain example embodiments, a sensor 760 can include a battery that is used to provide power, at least in part, to some or all of the rest of the sensor 760. In addition, or in the alternative, the power module 712 of the controller 704 can provide power to operate the sensor 760.

The user 750, the network manager 780, and/or other light fixtures can interact with the controller 704 of the light fixture 700 using the application interface 726 in accordance with one or more example embodiments. Specifically, the application interface 726 of the controller 704 receives data (e.g., information, communications, instructions, updates to firmware) from and sends data (e.g., information, communications, instructions) to the user 750, the network manager 780, and/or one or more other light fixtures. The user 750, the network manager 780, and/or each other light fixture can include an interface to receive data from and send data to the controller 704 in certain example embodiments. Examples of such an interface can include, but are not limited to, a graphical user interface, a touchscreen, an application programming interface, a keyboard, a monitor, a mouse, a web service, a data protocol adapter, some other hardware and/or software, or any suitable combination thereof.

The controller 704, the user 750, the network manager 780, and/or the other light fixtures can use their own system or share a system in certain example embodiments. Such a system can be, or contain a form of, an Internet-based or an intranet-based computer system that is capable of communicating with various software. A computer system includes any type of computing device and/or communication device, including but not limited to the controller 704. Examples of such a system can include, but are not limited to, a desktop computer with Local Area Network (LAN), Wide Area Network (WAN), Internet or intranet access, a laptop computer with LAN, WAN, Internet or intranet access, a smart phone, a server, a server farm, an android device (or equivalent), a tablet, smartphones, and a personal digital assistant (PDA). Such a system can correspond to a computer system as described below with regard to FIG. 8.

Further, as discussed above, such a system can have corresponding software (e.g., user software, controller software, network manager software). The software can execute on the same or a separate device (e.g., a server, mainframe, desktop personal computer (PC), laptop, PDA, television, cable box, satellite box, kiosk, telephone, mobile phone, or other computing devices) and can be coupled by the communication network (e.g., Internet, Intranet, Extranet, LAN, WAN, or other network communication methods) and/or communication channels, with wire and/or wireless segments according to some example embodiments. The software of one system can be a part of, or operate separately but in conjunction with, the software of another system within the system 799. The main light fixture portion 790 can include a housing 793. Similarly, the backbox 702 can include a housing 751. The housing 793 can include at least one wall that forms a cavity 791, and the housing 751 can include at least one wall that forms a cavity 701. In some cases, each housing, whether considered separately or when coupled to each other, can be designed to comply with any applicable standards so that the light fixture 700 can be located in a particular environment (e.g., a hazardous environment).

The housing 793 and/or the housing 751 of the light fixture 700 can be used to house one or more components of the light fixture 700, including one or more components of the controller 704. For example, as shown in FIG. 7, the controller 704 (which in this case includes the control engine 706, the communication module 708, the timer 710, the energy metering module 711, the power module 712, the storage repository 730, the hardware processor 720, the memory 722, the transceiver 724, the application interface 726, and the optional security module 728) is disposed within the cavity 701 formed by the housing 751, and the power supply 740 and the light sources 742 are disposed within the cavity 791 formed by the housing 793. In alternative embodiments, any one or more of these or other components of the light fixture 700 can be disposed on either housing and/or remotely from either housing.

The storage repository 730 can be a persistent storage device (or set of devices) that stores software and data used to assist the controller 704 in communicating with the user 750, the network manager 780, and one or more other light fixtures within the system 799. In one or more example embodiments, the storage repository 730 stores one or more protocols 732, algorithms 733, and stored data 734. The protocols 732 can be any of a number of communication protocols that are used to send and/or receive data between the controller 704 and the user 750, the network manager 780, and one or more other light fixtures 102. A protocol 732 can also include a process for controlling the light fixture 700. One or more of the protocols 732 can be a time-synchronized protocol. Examples of such time-synchronized protocols can include, but are not limited to, a highway addressable remote transducer (HART) protocol, a wireless HART protocol, and an International Society of Automation (ISA) 100 protocol. In this way, one or more of the protocols 732 can provide a layer of security to the data transferred within the system 799.

The algorithms 733 can be any procedures (e.g., a series of method steps), formulas, logic steps, mathematical models, and/or other similar operational procedures that the control engine 706 of the controller 704 follows based on certain conditions at a point in time. An example of an algorithm 733 is receiving a parameter measured by a sensor 760, determining (e.g., using an algorithm 733 and/or stored data 734) that the value of the parameter falls outside a range of values (e.g., threshold values, acceptable values), controlling the power supply 140 of the light fixture 700 based on the algorithm 733 and/or the stored data 734, and storing (e.g., using the stored data 734 in the storage repository 730) the measured data.

Algorithms 733 can be focused on controlling (e.g., dimming, turning on/off) the power supply 740 of the light fixture 700. For example, there can be one or more algorithms 733 that calculates a dimming level based on the amount of ambient light measured by the sensor 760. As another example, one or more algorithms 733 can be used to determine when power should be supplied to the power supply 740 based on movement detected by the sensor 760. An algorithm 733 can be fixed or modified (e.g., by a user 750, by the control engine 706) over time. Modification of an algorithm 733 can be based on one or more of a number of factors, including but not limited to new equipment (e.g., a new transceiver 724), input from a user 750, and correction based on actual data.

Stored data 734 can be any data (e.g., dimming capability of the power supply 740) associated with the light fixture 700, any measurements taken by the sensors 760, measurements taken by the energy metering module 711, threshold values, results of previously run or calculated algorithms 733, and/or any other suitable data. Such data can be any type of data, including but not limited to historical data for the light fixture 700, historical data for other light fixtures, calculations, an identification number of the light fixture 700, measurements taken by the energy metering module 711, and measurements taken by one or more sensors 760. The stored data 734 can be associated with some measurement of time derived, for example, from the timer 710.

Examples of a storage repository 730 can include, but are not limited to, a database (or a number of databases), a file system, a hard drive, flash memory, some other form of solid state data storage, or any suitable combination thereof. The storage repository 730 can be located on multiple physical machines, each storing all or a portion of the protocols 732, the algorithms 733, and/or the stored data 734 according to some example embodiments. Each storage unit or device can be physically located in the same or in a different geographic location.

The storage repository 730 can be operatively connected to the control engine 706. In one or more example embodiments, the control engine 706 includes functionality to communicate with the user 750, the network manager 780, and the sensors 760 in the system 799. More specifically, the control engine 706 sends information to and/or receives information from the storage repository 730 in order to communicate with the user 750, the network manager 780, and/or other light fixtures. As discussed below, the storage repository 730 can also be operatively connected to the communication module 708 in certain example embodiments.

In certain example embodiments, the control engine 706 of the controller 704 controls the operation of one or more components (e.g., the communication module 708, the timer 710, the transceiver 724) of the controller 704. For example, the control engine 706 can activate the communication module 708 when the communication module 708 is in "sleep" mode and when the communication module 708 is needed to send data received from another component (e.g., a sensor 760, the user 750) in the system 799.

As another example, the control engine 706 can acquire the current time using the timer 710. The timer 710 can enable the controller 704 to control the light fixture 700 even when the controller 704 has no communication with the network manager 780. As yet another example, the control engine 706 can direct the energy metering module 711 to measure and send power consumption information of the light fixture 700 to the network manager 780 and/or the user 750. In some cases, the control engine 706 of the controller 704 can generate and send a dimming signal (e.g., 0-10 V DC) to the power supply 740, which causes the power supply 740 to adjust the light output of the light sources 742.

The control engine 706 can be configured to perform a number of functions that help control the light fixture 700 (or components thereof) and, in some cases, one or more other light fixtures in the system 799. As discussed above, the control engine 706 can execute any of the algorithms 733 stored in the storage repository 730. In certain example embodiments, the control engine 706 controls the amount of power provided by the power supply 740 to the light sources 742, the color output by the light sources 742, flicker, strobe, or other effects of the light emitted by the light sources 742, and/or any other element associated with the light emitted by the light sources 742 of the light fixture 700.

The control engine 706 can provide control, communication, and/or other similar signals to the user 750, the network manager 780, and/or one or more other light fixtures. Similarly, the control engine 706 can receive control, communication, and/or other similar signals from the user 750, the network manager 780, and/or one or more other light fixtures. The control engine 706 can control each sensor 760 automatically (for example, based on one or more algorithms stored in the control engine 706) and/or based on control, communication, and/or other similar signals received from another component of the system 799 through a communication link 705. The control engine 706 may include a printed circuit board, upon which the hardware processor 720 and/or one or more discrete components of the controller 704 are positioned.

In certain embodiments, the control engine 706 of the controller 704 can communicate with one or more components of a system external to the system 799 in furtherance of controlling the light fixture 700 and, in some cases, one or more other light fixtures in the system 799. For example, the control engine 706 can interact with an inventory management system by ordering a replacement part (e.g., the power supply 740) for the light fixture 700 that the control engine 706 has determined to fail or be failing. As another example, the control engine 706 can interact with a workforce scheduling system by scheduling a maintenance crew to repair or replace the light fixture 700 (or portion thereof) when the control engine 706 determines that the light fixture 700 or portion thereof requires maintenance or replacement. In this way, the controller 704 is capable of performing a number of functions beyond what could reasonably be considered a routine task.

In certain example embodiments, the control engine 706 can include an interface that enables the control engine 706 to communicate with one or more components (e.g., power supply 740) of the light fixture 700. For example, if the power supply 740 of the light fixture 700 operates under IEC Standard 62386, then the power supply 740 can have a serial communication interface that will transfer data (e.g., stored data 734) with the control engine 706. In such a case, the control engine 706 can also include a serial interface to enable communication with the power supply 740 within the light fixture 700. Such an interface can operate in conjunction with, or independently of, the protocols 732 used to communicate between the controller 704 and the user 750, the network manager 780, and other light fixtures.

The control engine 706 (or other components of the controller 704) can also include one or more hardware components and/or software elements to perform its functions. Such components can include, but are not limited to, a universal asynchronous receiver/transmitter (UART), a serial peripheral interface (SPI), a direct-attached capacity (DAC) storage device, an analog-to-digital converter, an inter-integrated circuit (VC), and a pulse width modulator (PWM).

The communication module 708 of the controller 704 determines and implements the communication protocol (e.g., from the protocols 732 of the storage repository 730) that is used when the control engine 706 communicates with (e.g., sends signals to, receives signals from) the user 750, the network manager 780, and/or one or more other light fixtures. In some cases, the communication module 708 accesses the stored data 734 to determine which communication protocol is used to communicate with other light fixtures associated with the stored data 734. In addition, the communication module 708 can interpret the communication protocol of a communication received by the controller 704 so that the control engine 706 can interpret the communication.

The communication module 708 can send and receive data between the network manager 780, the sensors 760, other light fixtures, and/or the users 750 and the controller 704. The communication module 708 can send and/or receive data in a given format that follows a particular protocol 732. The control engine 706 can interpret the data packet received from the communication module 708 using the protocol 732 information stored in the storage repository 730. The control engine 706 can also facilitate the data transfer between one or more sensors 760 the network manager 780, other light fixtures, and/or a user 750 by converting the data into a format understood by the communication module 708.

The communication module 708 can send data (e.g., protocols 732, algorithms 733, stored data 734, operational information, alarms) directly to and/or retrieve data directly from the storage repository 730. Alternatively, the control engine 706 can facilitate the transfer of data between the communication module 708 and the storage repository 730. The communication module 708 can also provide encryption to data that is sent by the controller 704 and decryption to data that is received by the controller 704. The communication module 708 can also provide one or more of a number of other services with respect to data sent from and received by the controller 704. Such services can include, but are not limited to, data packet routing information and procedures to follow in the event of data interruption.

The timer 710 of the controller 704 can track clock time, intervals of time, an amount of time, and/or any other measure of time. The timer 710 can also count the number of occurrences of an event, whether with or without respect to time. Alternatively, the control engine 706 can perform the counting function. The timer 710 is able to track multiple time measurements concurrently. The timer 710 can track time periods based on an instruction received from the control engine 706, based on an instruction received from the user 750, based on an instruction programmed in the software for the controller 704, based on some other condition or from some other component, or from any combination thereof.

The timer 710 can be configured to track time when there is no power delivered to the controller 704 (e.g., the power module 712 malfunctions) using, for example, a super capacitor or a battery backup. In such a case, when there is a resumption of power delivery to the controller 704, the timer 710 can communicate any aspect of time to the controller 704. In such a case, the timer 710 can include one or more of a number of components (e.g., a super capacitor, an integrated circuit) to perform these functions.

The energy metering module 711 of the controller 704 measures one or more components of power (e.g., current, voltage, resistance, VARs, watts) at one or more points within the light fixture 700. The energy metering module 711 can include any of a number of measuring devices and related devices, including but not limited to a voltmeter, an ammeter, a power meter, an ohmmeter, a current transformer, a potential transformer, and electrical wiring. The energy metering module 711 can measure a component of power continuously, periodically, based on the occurrence of an event, based on a command received from the control engine 706, and/or based on some other factor.

The power module 712 of the controller 704 provides power to one or more other components (e.g., timer 710, control engine 706) of the controller 704. In addition, in certain example embodiments, the power module 712 can provide power to the power supply 740 of the light fixture 700. The power module 712 can include one or more of a number of single or multiple discrete components (e.g., transistor, diode, resistor), and/or a microprocessor. The power module 712 may include a printed circuit board, upon which the microprocessor and/or one or more discrete components are positioned. In some cases, the power module 712 can include one or more components that allow the power module 712 to measure one or more elements of power (e.g., voltage, current) that is delivered to and/or sent from the power module 712, Alternatively, the controller 704 can include a power metering module (not shown) to measure one or more elements of power that flows into, out of, and/or within the controller 704.

The power module 712 can include one or more components (e.g., a transformer, a diode bridge, an inverter, a converter) that receives power (for example, through an electrical cable) from a source external to the light fixture 700 and generates power of a type (e.g., alternating current, direct current) and level (e.g., 12V, 24V, 720V) that can be used by the other components of the controller 704 and/or by the power supply 740. The power module 712 can use a closed control loop to maintain a preconfigured voltage or current with a tight tolerance at the output. The power module 712 can also protect the rest of the electronics (e.g., hardware processor 720, transceiver 724) in the light fixture 700 from surges generated in the line.

In addition, or in the alternative, the power module 712 can be a source of power in itself to provide signals to the other components of the controller 704 and/or the power supply 740. For example, the power module 712 can be a battery. As another example, the power module 712 can be a localized photovoltaic power system. The power module 712 can also have sufficient isolation in the associated components of the power module 712 (e.g., transformers, opto-couplers, current and voltage limiting devices) so that the power module 712 is certified to provide power to an intrinsically safe circuit.

In certain example embodiments, the power module 712 of the controller 704 can also provide power and/or control signals, directly or indirectly, to one or more of the sensors 760. In such a case, the control engine 706 can direct the power generated by the power module 712 to the sensors 760 and/or the power supply 740 of the light fixture 700. In this way, power can be conserved by sending power to the sensors 760 and/or the power supply 740 of the light fixture 700 when those devices need power, as determined by the control engine 706.

The hardware processor 720 of the controller 704 executes software, algorithms, and firmware in accordance with one or more example embodiments. Specifically, the hardware processor 720 can execute software on the control engine 706 or any other portion of the controller 704, as well as software used by the user 750, the network manager 780, one or more other light fixtures, 102, and/or one or more of the sensors 760. The hardware processor 720 can be an integrated circuit, a central processing unit, a multi-core processing chip, SoC, a multi-chip module including multiple multi-core processing chips, or other hardware processor in one or more example embodiments. The hardware processor 720 is known by other names, including but not limited to a computer processor, a microprocessor, and a multi-core processor.

In one or more example embodiments, the hardware processor 720 executes software instructions stored in memory 722. The memory 722 includes one or more cache memories, main memory, and/or any other suitable type of memory. The memory 722 can include volatile and/or non-volatile memory. The memory 722 is discretely located within the controller 704 relative to the hardware processor 720 according to some example embodiments. In certain configurations, the memory 722 can be integrated with the hardware processor 720.

In certain example embodiments, the controller 704 does not include a hardware processor 720. In such a case, the controller 704 can include, as an example, one or more field programmable gate arrays (FPGA). Using FPGAs and/or other similar devices known in the art allows the controller 704 (or portions thereof) to be programmable and function according to certain logic rules and thresholds without the use of a hardware processor. Alternatively, FPGAs and/or similar devices can be used in conjunction with one or more hardware processors 720.

The transceiver 724 of the controller 704 can send and/or receive control and/or communication signals. Specifically, the transceiver 724 can be used to transfer data between the controller 704 and the user 750, the network manager 780, one or more other light fixtures 102, and/or the sensors 760 (e.g., if remote from the light fixture 700). The transceiver 724 can use wired and/or wireless technology. The transceiver 724 can be configured in such a way that the control and/or communication signals sent and/or received by the transceiver 724 can be received and/or sent by another transceiver that is part of the user 750, the network manager 780, one or more other light fixtures, and/or the sensors 760. The transceiver 724 can use any of a number of signal types, including but not limited to radio frequency signals.

When the transceiver 724 uses wireless technology, any type of wireless technology can be used by the transceiver 724 in sending and receiving signals. Such wireless technology can include, but is not limited to, Wi-Fi, visible light communication, cellular networking, and Bluetooth. The transceiver 724 can use one or more of any number of suitable communication protocols (e.g., ISA100, HART) when sending and/or receiving signals. Such communication protocols can be stored in the protocols 732 of the storage repository 730. Further, any transceiver information for the user 750, the network manager 780, and/or the sensors 760 can be part of the stored data 734 (or similar areas) of the storage repository 730.

Optionally, in one or more example embodiments, the security module 728 secures interactions between the controller 704, the user 750, the network manager 780, and/or the sensors 760. More specifically, the security module 728 authenticates communication from software based on security keys verifying the identity of the source of the communication. For example, user software may be associated with a security key enabling the software of the user 750 to interact with the controller 704 and/or the sensors 760. Further, the security module 728 can restrict receipt of information, requests for information, and/or access to information in some example embodiments.

As mentioned above, the main light fixture portion 790 can include a power supply 740 and one or more light sources 742. The light sources 742 of the light fixture 700 are devices and/or components typically found in a light fixture to allow the light fixture 700 to operate. The light fixture 700 can have one or more of any number and/or type of light sources 742. Examples of such light sources 742 (or components thereof) can include, but are not limited to, a local control module, a light source, a light engine, a heat sink, an electrical conductor or electrical cable, a terminal block, a lens, a diffuser, a reflector, an air moving device, a baffle, a dimmer, and a circuit board. A light source 742 can use any type of lighting technology, including but not limited to LED, incandescent, sodium vapor, and fluorescent.

The power supply 740 of the light fixture 700 provides power to one or more of the light sources 742. The power supply 740 can be called by any of a number of other names, including but not limited to a driver, a LED driver, and a ballast. The power supply 740 can be substantially the same as, or different than, the power module 712 of the controller 704. The power supply 740 can include one or more of a number of single or multiple discrete components (e.g., transistor, diode, resistor), and/or a microprocessor. The power supply 740 may include a printed circuit board, upon which the microprocessor and/or one or more discrete components are positioned, and/or a dimmer.

The power supply 740 can include one or more components (e.g., a transformer, a diode bridge, an inverter, a converter) that receives power (for example, through an electrical cable) from the power module 712 of the controller 704 and generates power of a type (e.g., alternating current, direct current) and level (e.g., 12V, 24V, 720V) that can be used by the light sources 742. In addition, or in the alternative, the power supply 740 can receive power from a source external to the light fixture 700. In addition, or in the alternative, the power supply 740 can be a source of power in itself. For example, the power supply 740 can be a battery, a localized photovoltaic power system, or some other source of independent power.

As stated above, the light fixture 700 can be placed in any of a number of environments. In such a case, the housing 793 of the main light fixture portion 790 and the housing 751 of the backbox 702, when coupled to each other, can be configured to comply with applicable standards for any of a number of environments. For example, the light fixture 700 can be rated as a Division 1 or a Division 2 enclosure under NEC standards. Similarly, any of the sensors 760 or other devices communicably coupled to the light fixture 700 can be configured to comply with applicable standards for any of a number of environments. For example, a sensor 760 can be rated as a Division 1 or a Division 2 enclosure under NEC standards.

Figure 8:
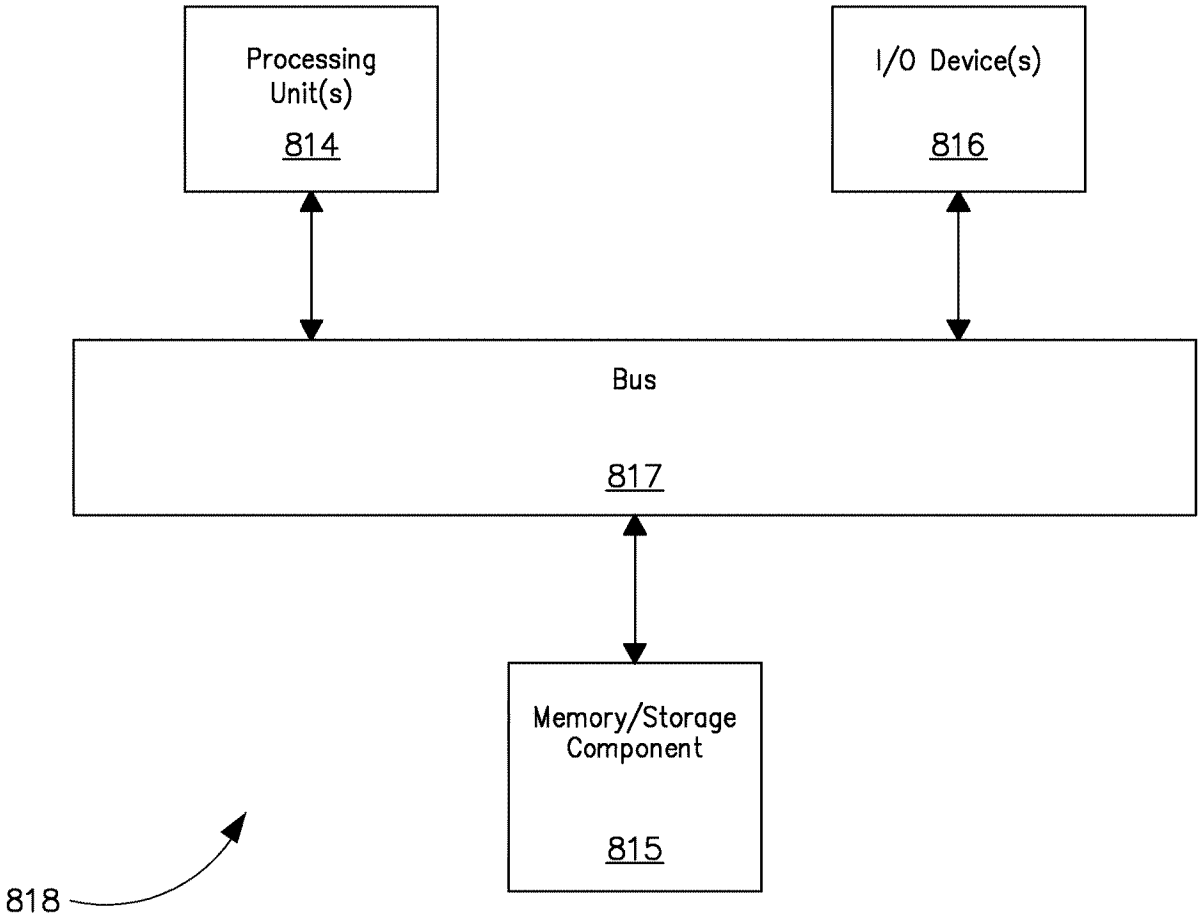
FIG. 8 shows a computing device in accordance with certain example embodiments.

FIG. 8 illustrates one embodiment of a computing device 818 that implements one or more of the various techniques described herein, and which is representative, in whole or in part, of the elements described herein pursuant to certain exemplary embodiments. Computing device 818 is one example of a computing device and is not intended to suggest any limitation as to scope of use or functionality of the computing device and/or its possible architectures. Neither should computing device 818 be interpreted as having any dependency or requirement relating to any one or combination of components illustrated in the example computing device 818.

Computing device 818 includes one or more processors or processing units 814, one or more memory/storage components 815, one or more input/output (I/O) devices 816, and a bus 817 that allows the various components and devices to communicate with one another. Bus 817 represents one or more of any of several types of bus structures, including a memory bus or memory controller, a peripheral bus, an accelerated graphics port, and a processor or local bus using any of a variety of bus architectures. Bus 817 includes wired and/or wireless buses.

Memory/storage component 815 represents one or more computer storage media. Memory/storage component 815 includes volatile media (such as random access memory (RAM)) and/or nonvolatile media (such as read only memory (ROM), flash memory, optical disks, magnetic disks, and so forth). Memory/storage component 815 includes fixed media (e.g., RAM, ROM, a fixed hard drive, etc.) as well as removable media (e.g., a Flash memory drive, a removable hard drive, an optical disk, and so forth).

One or more I/O devices 816 allow a customer, utility, or other user to enter commands and information to computing device 818, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 818 is connected to a network (not shown) (e.g., a local area network (LAN), a wide area network (WAN) such as the Internet, cloud, or any other similar type of network) via a network interface connection (not shown) according to some exemplary embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other exemplary embodiments. Generally speaking, the computer system 818 includes at least the minimal processing, input, and/or output means necessary to practice one or more embodiments.

Further, those skilled in the art will appreciate that one or more elements of the aforementioned computer device 818 is located at a remote location and connected to the other elements over a network in certain exemplary embodiments. Further, one or more embodiments is implemented on a distributed system having one or more nodes, where each portion of the implementation (e.g., control engine 706) is located on a different node within the distributed system. In one or more embodiments, the node corresponds to a computer system. Alternatively, the node corresponds to a processor with associated physical memory in some exemplary embodiments. The node alternatively corresponds to a processor with shared memory and/or resources in some exemplary embodiments.

Example embodiments can integrate sensing capability and control into a light fixture while providing aesthetic integrity. Example embodiments can be part of a new light fixture or retrofit into existing light fixtures. Example embodiments can be manufactured to have any shape and/or size to couple to and integrate with any type of light fixture. Example embodiments are also adjustable in where a sensing device is directed to more efficiently control the power supply of a light fixture.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A light fixture of a lighting system, comprising:

a power supply that provides power to at least one light source;

a main light fixture (LF) portion comprising at least one first backbox coupling feature, at least one second backbox coupling feature, and at least one main LF wall that forms a first cavity;

a backbox coupled to the main LF portion, wherein the backbox comprises at least one first main LF coupling feature, at least one second main LF coupling feature, a plurality of backbox walls that form a second cavity, and a sensor mounting feature disposed on at least one backbox wall of the plurality of backbox walls, wherein the at least one first main LF coupling feature is disposed at a distal end of the backbox and couples to the at least one first backbox coupling feature;

a sensor device coupled to the sensor mounting feature of the backbox; and a controller coupled to the sensor device and disposed within the second cavity of the backbox, wherein the first cavity and the second cavity face each other and are enclosed when the main LF portion and the backbox are coupled to each other, wherein the at least one second backbox coupling feature and the at least one second main LF coupling feature, when engaged with each other, form a liquid-tight seal that prevents liquid from entering the first cavity and the second cavity, wherein the at least one first backbox coupling feature and the at least one first main LF coupling feature are aligned for engagement with each other when the at least one second backbox coupling feature and the at least one second main LF coupling feature are engaged with each other, and wherein the power supply is disposed in the first cavity, wherein the backbox replaces a rear panel removed from the main LF portion.

2. The light fixture of claim 1, wherein the at least one first main LF coupling feature comprises a plurality of first apertures that traverse at least one backbox wall of the plurality of backbox walls.

3. The light fixture of claim 2, further comprising a plurality of fastening devices that traverse the plurality of first apertures and, at least in part, a plurality of second apertures in the main LF portion, wherein the at least one first backbox coupling feature of the main LF portion comprises the plurality of second apertures.

4. The light fixture of claim 3, wherein the plurality of backbox walls comprises a plurality of recesses that provide access to the plurality of fastening devices.

5. The light fixture of claim 4, wherein the backbox further comprises at least one standoff disposed within the second cavity and that extends toward the first cavity of the main LF portion.

6. The light fixture of claim 1, wherein the controller controls the power supply based on measurements taken by the sensor device.

7. The light fixture of claim 6 wherein the controller uses at least one algorithm to control the power supply.

8. The light fixture of claim 6, wherein controlling the power supply comprises a dimming function.

9. The light fixture of claim 1, wherein the backbox couples to the main LF portion at a back end of the main LF portion.

10. The light fixture of claim 9, wherein the main LF portion is part of an existing light fixture, and wherein the backbox is used to retrofit the existing light fixture.

11. The light fixture of claim 9, wherein the backbox and the main LF portion, when coupled to each other, form a substantially continuous housing.

12. The light fixture of claim 1, wherein the sensor device is a motion sensor that detects movement in a volume of space proximate to the sensor device.

13. The light fixture of claim 1, wherein the sensor mounting feature is mounted on a top wall of the plurality of backbox walls of the backbox, and wherein the sensor device measures a parameter located above the main LF portion.

14. The light fixture of claim 1, wherein the sensor mounting feature is mounted on a bottom wall of the plurality of backbox walls of the backbox, and wherein the sensor device measures a parameter located below the main LF portion.

15. The light fixture of claim 1, wherein the controller operates using a hardware processor.

16. The light fixture of claim 1, wherein main LF portion further comprises at least one throughhole through which at least one electrical conductor is disposed, wherein the at least one electrical conductor electrically couples the controller in the second cavity to at least one electrical component disposed in the first cavity.

17. A light fixture of a lighting system, comprising:

a power supply that provides power to at least one light source;

a main light fixture (LF) portion comprising at least one first backbox coupling feature, at least one second backbox coupling feature, and at least one main LF wall that forms a first cavity;

a backbox coupled to the main LF portion, wherein the backbox comprises at least one first main LF coupling feature, at least one second main LF coupling feature, a curved backbox wall that forms a second cavity, and a sensor mounting feature disposed on the curved backbox wall, wherein the at least one first main LF coupling feature is disposed at a distal end of the backbox and couples to the at least one first backbox coupling feature;

a sensor device coupled to the sensor mounting feature of the backbox; and a controller coupled to the sensor device and disposed within the second cavity of the backbox, wherein the first cavity and the second cavity face each other and are enclosed when the main LF portion and the backbox are coupled to each other, wherein the at least one second backbox coupling feature and the at least one second main LF coupling feature, when engaged with each other, form a liquid-tight seal that prevents liquid from entering the first cavity and the second cavity, wherein the at least one first backbox coupling feature and the at least one first main LF coupling feature are aligned for engagement with each other when the at least one second backbox coupling feature and the at least one second main LF coupling feature are engaged with each other, and wherein the power supply is disposed in the first cavity, wherein the backbox replaces a rear panel removed from the main LF portion.

* * * * *